US006260508B1

(12) United States Patent
Morse

(10) Patent No.: US 6,260,508 B1
(45) Date of Patent: Jul. 17, 2001

(54) POSITION INDICATING DEVICE AND METHOD OF USE

(76) Inventor: Lynn Morse, 611 Birch Grove, Irvine, CA (US) 92618

( * ) Notice: Subject to any disclaimer, the term of this patent is extended or adjusted under 35 U.S.C. 154(b) by 0 days.

(21) Appl. No.: 09/392,058

(22) Filed: Sep. 8, 1999

(51) Int. Cl.[7] ..... G08B 5/00
(52) U.S. Cl. ..... 116/211; 340/981
(58) Field of Search ..... 116/209, 211; 340/981, 961, 982, 945

(56) References Cited

U.S. PATENT DOCUMENTS

| | | | | |
|---|---|---|---|---|
| H1560 | * | 7/1996 | Gill et al. | 340/981 |
| 2,346,325 | * | 4/1944 | Oliver | 116/209 |
| 2,474,537 | | 6/1949 | MacLeod . | |
| 2,592,461 | | 4/1952 | Perkins et al. . | |
| 2,716,961 | | 9/1955 | Manheim et al. . | |
| 2,803,838 | * | 8/1957 | Wales, Jr. | 116/211 |
| 2,836,143 | * | 5/1958 | Shofi | 116/211 |
| 2,959,776 | * | 4/1960 | Morrah | 166/209 |
| 2,965,029 | * | 12/1960 | Jackson | 116/211 |
| 3,043,263 | | 7/1962 | Klopp et al. . | |
| 3,095,851 | * | 7/1963 | Lager | 116/211 |
| 3,157,890 | | 11/1964 | Mellon, Jr. et al. . | |
| 3,297,585 | | 1/1967 | Hayden . | |
| 3,313,268 | | 4/1967 | Reiffel . | |
| 3,323,117 | * | 5/1967 | Mason | 116/209 |
| 3,670,692 | * | 6/1972 | Jackson | 116/211 |
| 3,874,326 | | 4/1975 | Pickens . | |
| 4,376,421 | | 3/1983 | Skinner . | |
| 5,031,930 | | 7/1991 | Sato . | |
| 5,769,451 | | 6/1998 | Inada et al. . | |
| 5,929,788 | * | 7/1999 | Vukosic | 340/981 |

FOREIGN PATENT DOCUMENTS

| | | | |
|---|---|---|---|
| 244712 | * | 2/1975 | (DE) . |
| 1403120 | * | 8/1973 | (GB) . |
| WO 96/35594 | | 11/1996 | (WO) . |

* cited by examiner

*Primary Examiner*—Diego Gutierrez
*Assistant Examiner*—Jason P. Gilchrist
(74) *Attorney, Agent, or Firm*—Eric Karich

(57) ABSTRACT

A position indicator device for marking the location of an aircraft that has crashed has a buoyant housing containing a radio beacon, a dye dispenser, and a visual beacon. Upon the crash of the aircraft, the buoyant housing is deployed by an air bag ejection system. Upon deployment, a control wire pulls a control pin from a controller, thereby activating the radio beacon, dye dispenser, and visual beacon. The radio beacon immediately alerts emergency personnel that a crash has occurred and can guide the emergency personnel to the scene. The dye dispenser slowly releases a liquid dye that stains the water an easily recognizable color. The visual beacon not only allows crash survivors to find the position indicator device and gather together for survival and rescue, it also allows emergency personnel to find the position indicator device in bad weather or at night.

12 Claims, 2 Drawing Sheets

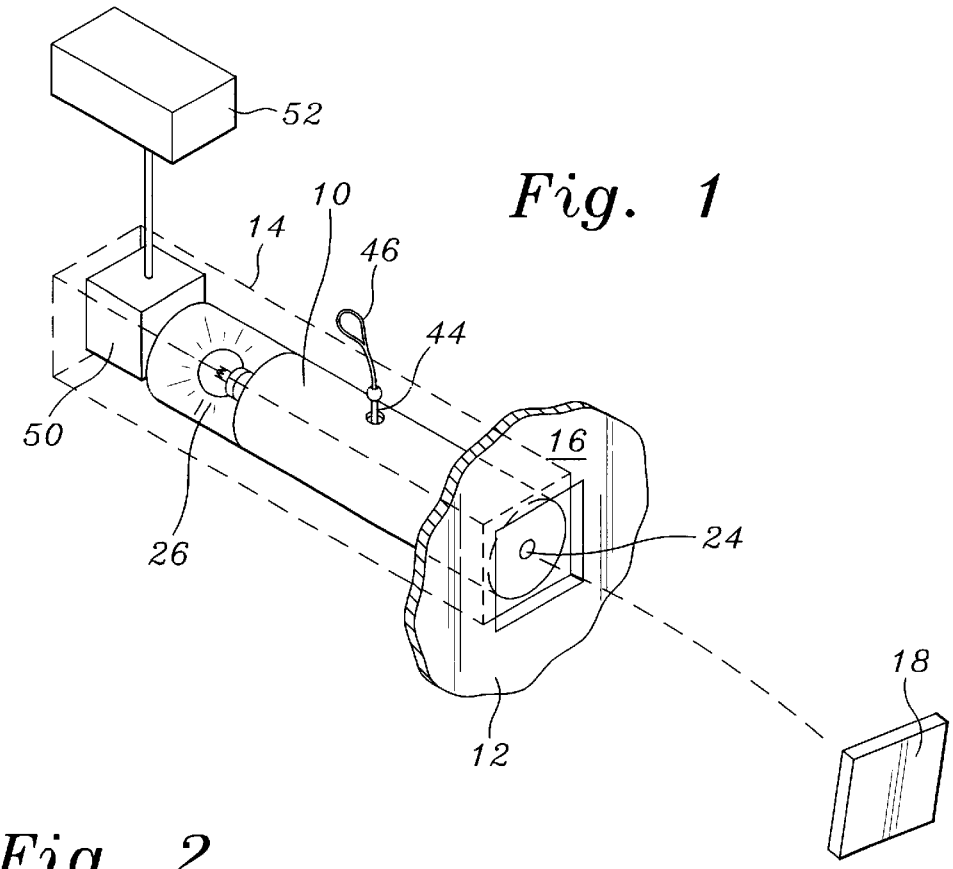
Fig. 1
Fig. 2
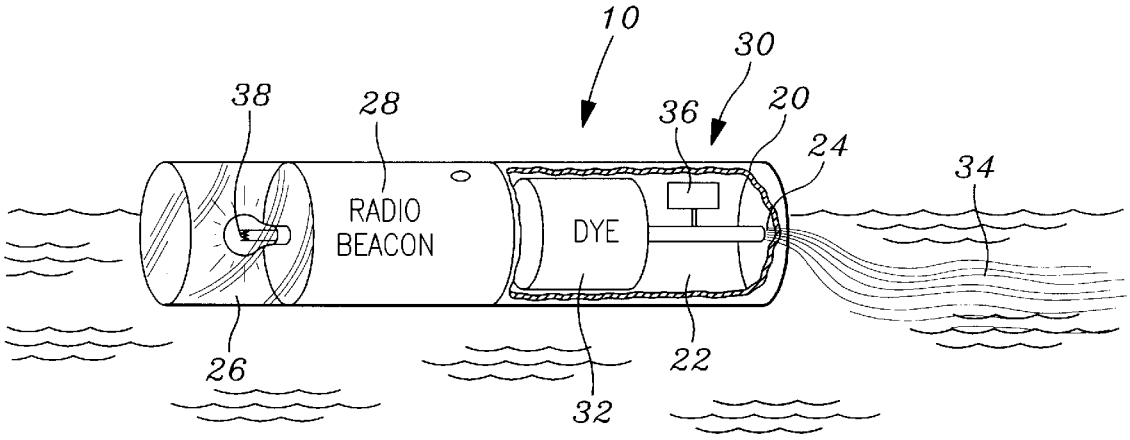

POSITION INDICATING DEVICE AND METHOD OF USE

BACKGROUND OF THE INVENTION

1. Field of the Invention

This invention relates generally to devices of the type designed to aid survivors of aircraft crashes by aiding rescue personnel searching for such downed aircraft, and more particularly relates to a device that simultaneously flashes a visual signal, emits a radio beacon, and releases a highly visible dye that stains the surrounding ground or water and thereby marks the spot that the aircraft crashed.

2. Description of Related Art

There is a long felt need for a position locator device that will quickly direct search and rescue teams to the location of an aircraft crash. This need is especially acute when the aircraft has crashed into the ocean because crash survivors can only be expected to survive a short period in the ocean before they drown or die of shock and hypothermia.

Prior art devices have focussed on buoyant dye dispensing devices that stain the water in the vicinity of the crash site. While this is often helpful, it is not always enough, particularly at night or foul weather when the dye is not readily visible. Many crash survivors will perish while the searchers wait for daylight or clear conditions; and by the time it is light enough and clear enough to search, the dye dispenser will have floated away from the crash site so it will no longer mark the correct location.

The prior art teaches buoyant dye dispensing devices that stain the water in the vicinity of the crash site. However, the prior art does not teach a buoyant crash locator device that is useful in the dark and under any weather conditions. The present invention fulfills these needs and provides further related advantages as described in the following summary.

SUMMARY OF THE INVENTION

The present invention teaches certain benefits in construction and use which give rise to the objectives described below.

The present invention provides a position indicator device for marking the location of an aircraft that has crashed. The position indicator device includes a buoyant housing containing a radio beacon, a dye dispenser, and a visual beacon. Upon the crash of the aircraft, the buoyant housing is deployed with an ejecting means and the radio beacon, dye dispenser, and visual beacon are activated with an activating means. The radio beacon immediately alerts emergency personnel that a crash has occurred and can guide the emergency personnel to the scene. The dye dispenser slowly releases a liquid dye that stains the water an easily recognizable color. The visual beacon not only allows crash survivors to find the position indicator device and gather together for survival and rescue, it also allows emergency personnel to find the position indicator device in bad weather or at night.

A primary objective of the present invention is to provide a position indicator device having advantages not taught by the prior art.

Another objective is to provide a position indicator device that includes both a dye dispenser and a visual beacon. While the dye dispenser provides an emergency signal that is well known in the art, the visual beacon provides two additional benefits that compliment the dye marker and overcome the disadvantages of the prior art dye dispenser. First, the visual beacon provides guidance to emergency rescue personnel when it is dark or the weather is too poor to see the dye released by the dye dispenser. Second, the visual beacon allows crash survivors to spot the position indicator device in the water. When the crash survivors are able to find the position indicator device, they are able to gather around the rescue beacon and even use the position indicator device as an emergency flotation device. Crash survivors will thus be able to stay close to the position indicator device even after the device has been floating for hours and even days in ocean currents.

A further objective is to provide a radio beacon that functions to guide emergency rescue personnel to the group of floating crash survivors rather than just to the remains of the crashed aircraft. Not only does this correct for the movement of the crash survivors in ocean currents, it also allows crash survivors to attempt to move themselves towards land without losing the hope of rescue near the crash site.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 1 is a perspective view of the preferred embodiment of a position indicator device installed in an aircraft;

FIG. 2 is a perspective view of the position indicator device floating in an ocean following the crash of the aircraft, a portion of the buoyant housing of the position indicator device being cut away to show the dye dispenser located inside the buoyant housing.

DETAILED DESCRIPTION OF THE INVENTION

Figure 3:
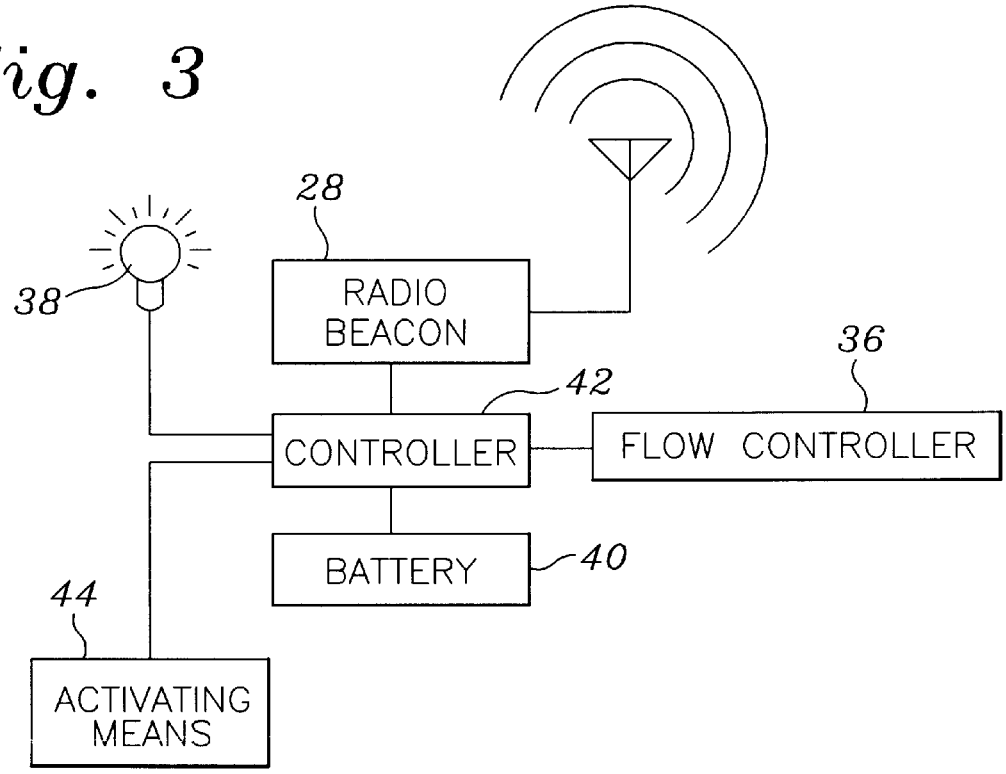
FIG. 3 is a block diagram of the position indicator device.

The above described drawing figures illustrate the invention, a position indicator device 10 for marking the location of an aircraft 12 that has crashed. The position indicator device 10 includes a buoyant housing 20 containing a radio beacon 28, a dye dispenser 30, and a visual beacon 38. Upon the crash of the aircraft 12, the buoyant housing 20 is deployed and the radio beacon 28, dye dispenser 30, and visual beacon 38 are activated. The radio beacon 28 immediately alerts emergency personnel that a crash has occurred and can guide the emergency personnel to the scene. The dye dispenser 30 slowly releases a liquid dye 34 that stains the water an easily recognizable color. The visual beacon 38 not only allows crash survivors to find the position indicator device 10 and gather together for survival and rescue, it also allows emergency personnel to find the position indicator device 10 in bad weather or at night.

Buoyant Housing

The buoyant housing 20 is preferably constructed of rigid, durable, shock resistant plastic. Plastic is not only very strong, durable, and corrosion resistant, it also tends to be inherently buoyant. The buoyant housing 20 preferably includes additional plastic or foam insulation that not only shields the internal components from damage, but also provides additional buoyancy. It is important that the position indicator device 10 ride as high in the water as possible to provide the most visible beacon. It is also desirable that the position indicator device 10 be capable of providing flotation to crash survivors who lack life vests. The buoyant housing 20 preferably has a watertight internal compartment 22 for containing the radio beacon 28, the dye dispenser 30, and the visual beacon 38. The buoyant housing 20 preferably includes a transparent portion 26 for emitting the visual beacon 38 through the buoyant housing 20. The buoyant housing 20 preferably further includes an ejection conduit 24 through which dye from the dye dispenser 30 can be ejected.

Dye Dispenser, Radio Beacon, and Visual Beacon

The radio beacon 28, preferably mounted within the watertight internal compartment 22 of the buoyant housing 20, is preferably a radio transmitter pre-programmed to transmit a distress call on an emergency frequency. Similar radio beacons are well known in the art and are required on most aircraft today. The dye dispenser 30 preferably includes a dye container 32 having a supply of liquid dye 34. Upon activation of the position indicator device 10, a flow controller 36 allows the liquid dye 34 to flow through the ejection conduit 24 and into the environment. The flow controller 36 is preferably a flow control valve capable of slowly releasing the liquid dye 34 through the ejection conduit 24 in response to a signal from the controller 42. While other types of dye can be adapted to this invention, including dyes in solid or powder form, liquid dye 34 is preferred because its release can be easily controlled by the flow controller 36. The visual beacon 38 can be a flashing lamp having a traditional incandescent filament; however, the visual beacon 38 is preferably at least one flashing LED. At least one flashing LED 38 is preferred because LEDs are less likely to be damaged during a violent aircraft crash and they consume far less power than a flashing lamp having a traditional incandescent filament. Although a single LED is not as strong as a flashing lamp, a plurality of LEDs can be used to increase the strength of the visual beacon 38. The visual beacon 38 is preferably located within the watertight internal compartment 22 of the position indicator device 10 and covered by a transparent portion 26 to allow light from the visual beacon 38 to be transmitted in all directions.

Inside the buoyant housing 20 a battery 40 is electronically connected to a controller 42. The controller 42 is operatively connected to the radio beacon 28, the dye dispenser 30, and the visual beacon 38. The position indicator device 10 further includes a means for activating 44 the controller 42 to electronically connect the battery 40 to the radio beacon 28, the dye dispenser 30, and the visual beacon 38. The activating means 44 is preferably a control pin operatively inserted into the side of the position indicator device 10 such that when the control pin 44 is pulled from the position indicator device 10, the controller 42 activates the radio beacon 28, the dye dispenser 30, and the visual beacon 38.

Automatic Ejection and Activation System

While a passenger or a pilot of the aircraft 12 may manually transport and activate the position indicator device 10, in the preferred embodiment the position indicator device 10 stored within the aircraft 12 and automatically ejected and activated in the event of a crash. In this embodiment, the aircraft 12 has an indicator compartment 14 shaped to receive the position indicator device 10 described above. The indicator compartment 14 is preferably covered with an external skin 16 having an ejection portion 18. The ejection portion 18 is preferably designed to allow the position indicator device 10 to punch through the external skin 16 in the event of a crash. The position indicator device 10 is mounted within the indicator compartment 14 and automatically ejected by a means for ejecting 50 the position indicator device 10 through the ejection portion 18 and out of the indicator compartment 14 of the aircraft 12 when the aircraft 12 crashes. In this embodiment, the aircraft 12 further includes a means for activating the controller 42 of the position indicator device 10 when it is ejected from the indicator compartment 14.

The ejecting means 50 is preferably an air bag actuated by a means of sensing 52 when the aircraft 12 has crashed. When the aircraft 12 crashes, the sensing means 52 activates the air bag 50 which expands to eject the position indicator device 10 from the indicator compartment 14. Air bags 50 and aviation crash sensor 52 are well known in the prior art and thus do not require a detailed discussion. The sensing means 52 is preferably an aviation crash sensor, preferably including a triaxial accelerometer and a microcontroller (not shown), capable of sensing a crash and also capable of distinguishing a crash from an ordinary jolt such as can be expected from a rough landing. An acceptable aviation crash sensor 52 is described in Happ, WO 96/35594, and can be readily designed by those skilled in the art. The air bag 50 is preferably a system that includes both an inflater and a bag (not shown), the bag being positioned to eject the position indicator device 10. An example of an acceptable air bag 50 system is described in Inada et al., U.S. Pat. No. 5,769,451, and Sato, U.S. Pat. No. 5,031,930, both patents hereby incorporated by reference in full. In addition to the air bag 50, other devices can be used as an ejecting means 50. One alternative form of the ejecting means 50 uses a spring biased to eject the position indicator device 10 upon release by a sensor element (not shown). Another form of ejecting means 50 is disclosed in Reiffel, U.S. Pat. No. 3,313,268, hereby incorporated by reference in fill. While the above-described structures are currently preferred, those skilled in the art can devise many alternative devices without altering the spirit of this invention.

The activating means 44 is preferably a control pin 44 operatively inserted into the side of the position indicator device 10 and operably connected to the controller 42. Upon removal of the control pin 44, the controller 42 activates the radio beacon 28, the dye dispenser 30, and the visual beacon 38 as described above. It is possible to manually activate the position indicator device 10 by simply pulling the control pin 44 by hand. In the preferred embodiment, the control pin 44 is attached to the aircraft 12 with a control wire 46 such that when the position indicator device 10 is ejected from the aircraft 12, the control wire 46 pulls the control pin 44 from the position indicator device 10, thereby causing the controller 42 to activate the radio beacon 28, the dye dispenser 30, and the visual beacon 38. While the above-described structure is currently preferred, those skilled in the art can devise many alternative methods without altering the spirit of this invention. One alternative form of the activating means 44 includes an electronic activating means 44 such as a transmitter/receiver that receives an electronic signal from an outside source (not shown) to cause the controller 42 to activate the radio beacon 28, the dye dispenser 30, and the visual beacon 38. Another alternative would be to utilize a sensor chip similar to the air bag 50 sensor chip that would directly activate the controller 42 in response to a crash, in response to the position indicator device 10 being immersed in water, or any other appropriate external stimuli.

Method of Use

The invention includes a method for indicating the position of a crashed aircraft 12 using the position indicator device 10 described above. In use, the position indicator device 10 is positioned inside the indicator compartment 14 of the aircraft 12. In the event of a crash, the ejecting means 50 ejects the position indicator device 10. Ejecting the position indicator device 10 causes the activating means 44 to activate the controller 42, which activates the radio beacon 28, the dye dispenser 30, and the visual beacon 38. In its preferred embodiment, the microchip sensor of an air bag 50 senses the crash and activates the air bag 50, causing it to inflate and eject the position indicator device 10 through the ejection portion 18 of the external skin 16 of the aircraft 12. A control pin 44 is pulled from the position indicator device 10 by the control wire 46 when the position indicator device 10 is ejected from the aircraft 12. Upon removal of the control pin 44, the controller 42 activates the radio beacon 28, the dye dispenser 30, and the visual beacon 38 as described above.

Once the position indicator device 10 has been ejected and activated, the radio beacon 28 begins broadcasting a distress beacon that can readily be received and tracked by emergency rescue personnel. Upon arriving at the scene of the crash, the emergency rescue personnel can search for stain left by the liquid dye 34 in the water. If the crash occurred at night, the emergency rescue personnel can also search for the light signal of the visual beacon 38. Meanwhile, crash survivors can congregate around the position indicator device 10 by following the visual beacon 38. The radio beacon 28 will continue to operate because it will remain on the water's surface, rather than sinking with the aircraft 12 and possibly being crushed in deep waters. Even if the crash survivors drift a great distance in the current, the beacons will continue to lead emergency rescue personnel to their location.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A position indicator device for marking the location of an aircraft that has crashed, the device comprising:

a buoyant housing containing a battery electronically connected to a controller;

a dye dispenser operably connected to the controller;

a visual beacon operably connected to the controller; and a means for activating the controller to electronically connect the battery to a radio beacon, the dye dispenser, and the visual beacon.

2. The device of claim 1 wherein the dye dispenser includes a dye container having a supply of liquid dye, the dye container having an ejection conduit, a flow control valve releasing the liquid dye through the ejection conduit in response to a signal from the controller.

3. The device of claim 1 wherein the activating means is a control pin operatively inserted into the side of the position indicator device such that when the control pin is pulled from the position indicator device, the controller activates the radio beacon, the dye dispenser, and the visual beacon.

4. The device of claim 1 wherein the visual beacon is a flashing lamp.

5. The device of claim 1 wherein the visual beacon is at least one flashing LED.

6. A position indicator device for marking the location of an aircraft that has crashed, the device comprising:

a buoyant housing having a watertight internal compartment, the buoyant housing having an ejection conduit and a transparent portion;

the internal compartment containing a battery electronically connected to a controller, the controller being operably connected to a radio beacon, a visual beacon, and a dye dispenser, the dye dispenser being connected to the ejection conduit through a flow control valve, the flow control valve releasing the liquid dye through the ejection conduit in response to a signal from the controller, the visual beacon being positioned adjacent to the transparent portion; and a means for activating the controller to electronically connect the battery to the radio beacon, the dye dispenser, and the visual beacon.

7. The device of claim 6 wherein the visual beacon is a flashing lamp.

8. The device of claim 6 wherein the visual beacon is at least one flashing LED.

9. The device of claim 6 wherein the activating means is a control pin operatively inserted into the side of the position indicator device such that when the control pin is pulled from the position indicator device, the controller activates the radio beacon, the dye dispenser, and the visual beacon.

10. A method for indicating the position of a crashed aircraft, the method comprising the steps of:

a) providing a position indicator device comprising a buoyant housing containing a battery electronically connected to a controller; a radio beacon operably connected to the controller; a dye dispenser operably connected to the controller; a visual beacon operably connected to the controller; and a means for activating the controller to electronically connect the battery to the radio beacon, the dye dispenser, and the visual beacon;

b) providing an aircraft having an indicator compartment, a means for ejecting the position indicator device from the indicator compartment and the aircraft when the aircraft crashes, and a means for activating the controller when the position indicator device is ejected from the indicator compartment;

c) positioning the position indicator device inside the indicator compartment;

d) ejecting the position indicator device with the ejecting means upon the crash of the aircraft; and e) activating the controller with the activator means when the position indicator device is ejected from the indicator compartment, the controller activating the radio beacon, the dye dispenser, and the visual beacon.

11. The method of claim 10 wherein the ejecting means is an air bag actuated by a means of sensing when the aircraft has crashed, wherein the sensing means activates the air bag causing it to expand and eject the position indicator device from the indicator compartment.

12. The method of claim 11 wherein the activating means is a control pin operatively inserted into the side of the position indicator device, the control pin being attached to the aircraft with a control wire such that when the position indicator device is ejected from the aircraft, the control wire pulls the control pin from the position indicator device, thereby causing the controller to activate the radio beacon, the dye dispenser, and the visual beacon.

* * * * *